US006076492A

United States Patent [19]

Takahashi

[11] Patent Number: 6,076,492

[45] Date of Patent: Jun. 20, 2000

[54] CYLINDER HEAD FOR VARIABLE VALVE TIMING

[75] Inventor: Hironao Takahashi, Iwata, Japan

[73] Assignee: Yamaha Hatsudoki Kabushiki Kaisha, Iwata, Japan

[21] Appl. No.: 09/277,663

[22] Filed: Mar. 26, 1999

[30] Foreign Application Priority Data

Mar. 27, 1998 [JP] Japan ..... 10-100033

[51] Int. Cl.[7] ..... F02F 1/24; F02D 13/00

[52] U.S. Cl. ..... 123/90.17; 123/90.34; 123/196 A; 123/193.3

[58] Field of Search ..... 123/90.15, 90.17, 123/90.31, 90.33, 90.34, 90.38, 196 A, 193.5, 193.3

[56] References Cited

U.S. PATENT DOCUMENTS

| | | | |
|---|---|---|---|
| 5,012,773 | 5/1991 | Akasaka et al. | 123/90.17 |
| 5,150,675 | 9/1992 | Murata | 123/193.5 |
| 5,189,999 | 3/1993 | Thorma | 123/90.17 |
| 5,301,639 | 4/1994 | Satou | 123/90.17 |
| 5,353,755 | 10/1994 | Matsuo et al. | 123/90.13 |
| 5,458,099 | 10/1995 | Koller et al. | 123/193.5 |
| 5,474,038 | 12/1995 | Golovatai-Schmidt et al. | 123/90.17 |
| 5,540,197 | 7/1996 | Golovatai-Schmidt et al. | 123/90.17 |
| 5,606,941 | 3/1997 | Trzmiel et al. | 123/90.15 |
| 5,669,343 | 9/1997 | Adachi | 123/90.17 |
| 5,713,319 | 2/1998 | Tortul | 123/90.17 |
| 5,718,196 | 2/1998 | Uchiyama et al. | 123/195 C |
| 5,797,363 | 8/1998 | Nakamura | 123/90.17 |
| 5,799,631 | 9/1998 | Nakamura | 123/90.17 |
| 5,829,399 | 11/1998 | Scheidt et al. | 123/90.17 |

*Primary Examiner*—Weilun Lo
*Attorney, Agent, or Firm*—Knobbe, Martens, Olson & Bear LLP

[57] ABSTRACT

A variable valve timing mechanism for an internal combustion engine wherein the camshaft is supported at one end by a combined bearing and valve body member that is detachably connected to the supporting engine body. The connection is such that fluid from the engine lubricating system can be delivered to this body and distributed by a control valve mounted in it. This simplifies machining of the engine body and permits a more compact, lower cost construction without sacrificing any function. The control valve is mounted in a bore that is accessible through the side of the cylinder head and is actuated by a servo motor mounted on the exterior of the cylinder head to provide a compact, rigid and easily serviced assembly.

15 Claims, 8 Drawing Sheets

CYLINDER HEAD FOR VARIABLE VALVE TIMING

BACKGROUND OF THE INVENTION

This invention relates to an internal combustion engine cylinder head structure for engines having variable valve timing and more particularly to an improved control valve and mounting arrangement for such cylinder head.

In order to improve the performance of internal combustion engines over widely varying speed and load ranges, it has been proposed to employ a variable valve timing (VVT) mechanism. With these mechanisms, the phase angle between the crankshaft and the camshaft can be changed so as to adjust the valve timing events. In this way, it is possible to obtain optimum valve timing for a wider range of engine running characteristics and conditions than when fixed valve timing is employed. The variable valve timing mechanism may be associated with either a single camshaft that operates all of the valves, or with either or both of an intake and exhaust camshaft.

The most popular form of VVT mechanism employs a hydraulic actuator that is effective to change the phase angle between the crankshaft and the camshaft. These variable valve timing mechanisms are normally provided at one end of the camshaft with which they are associated. This tends to increase the overall length of the engine.

In addition, it is necessary to provide a valve mechanism for selectively pressurizing or depressurizing various portions of the VVT mechanism in order to obtain the phase angle shift. This requires additional machining, not only for the elements of the valve, but also the passages that interconnect the valve to the variable valve timing mechanism.

If the valve body and passages are formed primarily in the cylinder head, this means that machining operations must be performed in the cylinder head, which is a somewhat awkward procedure.

It has, therefore, been proposed to employ a separate body which forms a dual function of journaling the camshaft and also providing the valve body and flow passages. However, the use of such a separate body tends to itself elongate the engine, particularly if the separate body is fixed to the cylinder head in a manner other than via the cylinder head to cylinder block fasteners. If the same fasteners are employed for fixing this extra valve body to the cylinder head as fix the cylinder head to the cylinder block, then the torque stresses of the hold down bolts may be high enough to deform the fluid passages and valve bores.

It has, therefore, been proposed to employ a separate arrangement wherein the valve body and bearing member is affixed to the cylinder head independently of the bolts or fasteners that fix the cylinder head to the cylinder block. Such an arrangement is disclosed in the co-pending application of Masahiro Uchida, entitled: "Variable Valve Timing Mechanism for Engine", Ser. No. 09/195,356 filed Nov. 19, 1998 and assigned to the assignee hereof.

In addition to providing not only the valve body in which the flow control valve is positioned, it is also necessary to mount an actuator for operating the valve element. That application shows an arrangement wherein the valve elements reciprocate about axes that extend generally parallel to the cylinder bores and hence, permits the mounting of the valve actuating elements in a like direction where they can extend through the cam cover of the engine. However, this gives rise to a number of results which may not be desirable under some circumstances.

First, the valve actuator passes through an element that is not rigidly located relative to the cylinder head, in most instances, and hence, misalignment and binding may occur. Furthermore, there is the problem of sealing.

Even though it is desirable to mount the actuator for the valve in such a position that it can be accessible, the upward projection of the valve actuator does not afford adequate protection, even though it makes the component more accessible.

It is, therefore, a principle object of this invention to provide an improved mounting arrangement for the camshaft of a variable valve timing mechanism in an engine, and wherein the valve element and its actuator are constructed in such a way as to permit a compact engine construction, ease of accessibility for the valve actuator, and protection of the valve actuator from elements and misalignment that could interfere with its operation.

SUMMARY OF THE INVENTION

This invention is adapted to be embodied in a cylinder head for an internal combustion engine variable valve timing mechanism. The cylinder head comprises a main cylinder head member. A bearing member defines a bearing surface for journaling a corresponding bearing surface of a camshaft. The camshaft has a portion that extends on one side of the bearing member bearing surface. A hydraulically operated variable valve drive element is provided for changing the phase angle between the camshaft and a camshaft drive element that is associated with this extending camshaft portion. A hydraulic conduit extends through the bearing member for supplying controlled hydraulic actuating fluid to said hydraulically-operated variable valve-drive element. The bearing member is detachably connected to the main cylinder head member independently of fasteners that fix the main cylinder head member to an associated cylinder block. An operating valve element for controlling the supply of hydraulic fluid through the hydraulic conduit is mounted in the bearing member. A valve actuator is mounted directly on the main cylinder head member for actuating the operating valve element.

DETAILED DESCRIPTION OF THE PREFERRED EMBODIMENTS

Figure 1:
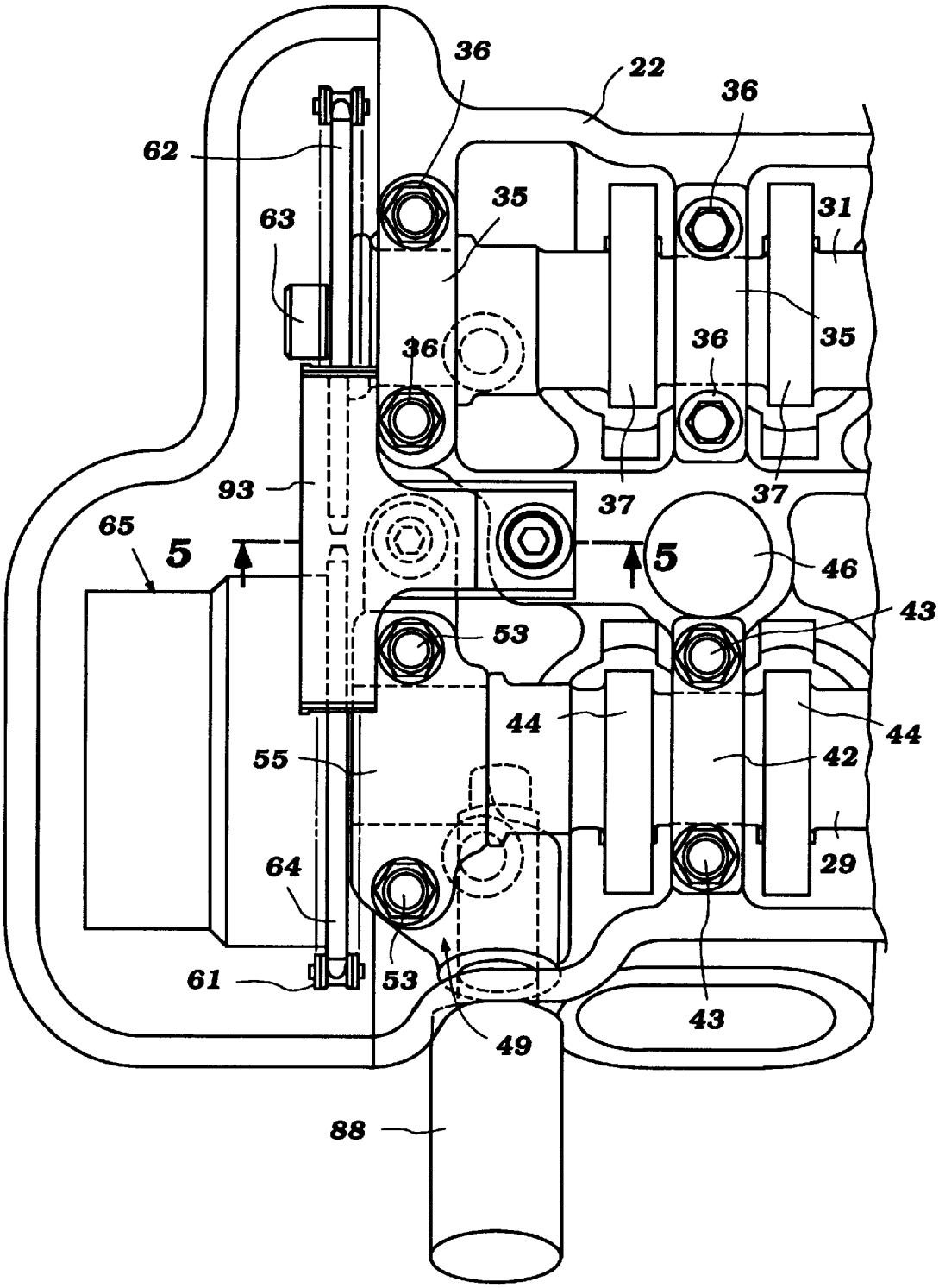
FIG. 1 is a top plan view of a portion of a cylinder head assembly constructed in accordance with a first embodiment of the invention, with the cam cover removed so as to more clearly show the internal construction.

Referring first in detail to the embodiment of FIG. 1–8, only a portion of a cylinder head of a twin overhead camshaft, internal combustion engine constructed in accordance with this embodiment is illustrated. From the foregoing description, it should be readily apparent that the invention deals primarily with the cylinder head assembly and the variable valve timing mechanism therefor. Therefore, only this portion of the engine is depicted. It will be readily apparent to those skilled in the art from the following description how the invention can be utilized with a wide variety of engines having varying constructions.

The cylinder head assembly is indicated generally by the reference numeral 21 and includes a main cylinder head member 22 that may be formed from a suitable material, such as a light alloy casting. This main cylinder member 22 has a lower surface 23 that is adapted to be held in a sealing relationship with an associated cylinder block (not shown) by a plurality of threaded fasteners 24 in a manner which will be described.

A camshaft and valve operating mechanism is mounted in the upper portion of the cylinder head member 22 in a cam chamber which is closed by a cam cover 25 that is affixed to the main cylinder head member 22 by means of a plurality of threaded fasteners which are not illustrated. At the forward end of this cam chamber, indicated by the reference numeral 26, there is provided a timing case chamber 27 that is closed by a timing cover 28.

As has been noted, in the illustrated embodiments, the engine with which the cylinder head assembly 21 is associated is of the twin overhead camshaft type. This arrangement includes an intake camshaft 29 that is journaled on one side of the cylinder head assembly 21 and an exhaust camshaft 31 that is journaled on the other side of the cylinder head assembly 21. The journaling for the intake and exhaust camshafts 29 and 31 will be described shortly.

On the exhaust camshaft side, the cylinder head member 22 is formed with a plurality of bridge portions 32 that form bearing surfaces 33 for rotatably journaling respective bearing portions 34 of the exhaust camshaft 31. Bearing caps 35 complete the bearing arrangement for the exhaust camshaft 31. These bearing caps 35 are connected to the bridge portions 32 by threaded fasteners 36.

As may be seen, the engine construction is formed of the four valve per cylinder type and, accordingly, the exhaust camshaft 31 is provided with a pair of cam lobes 37 disposed on opposite sides of the cylinder head bridge portions 32 for actuating the exhaust valves through a suitable valve actuating mechanism. This valve actuating mechanism may comprise thimble tappets that are mounted in tappet receiving bores 38 formed in the main cylinder head member 22 (FIG. 2).

Except for its forward-most bearing portion, the intake camshaft 29 is similarly journaled within the cylinder head member 22. The bridge portions 32 have further portions 39 that extend on the opposite side of the cylinder head and which receive and journal bearing portions 41 of the intake camshaft 29. Intake bearing caps 42 are affixed to these bridge portions 39 by threaded fasteners 43 and complete this journaling of the intake camshaft 29.

Figure 2:
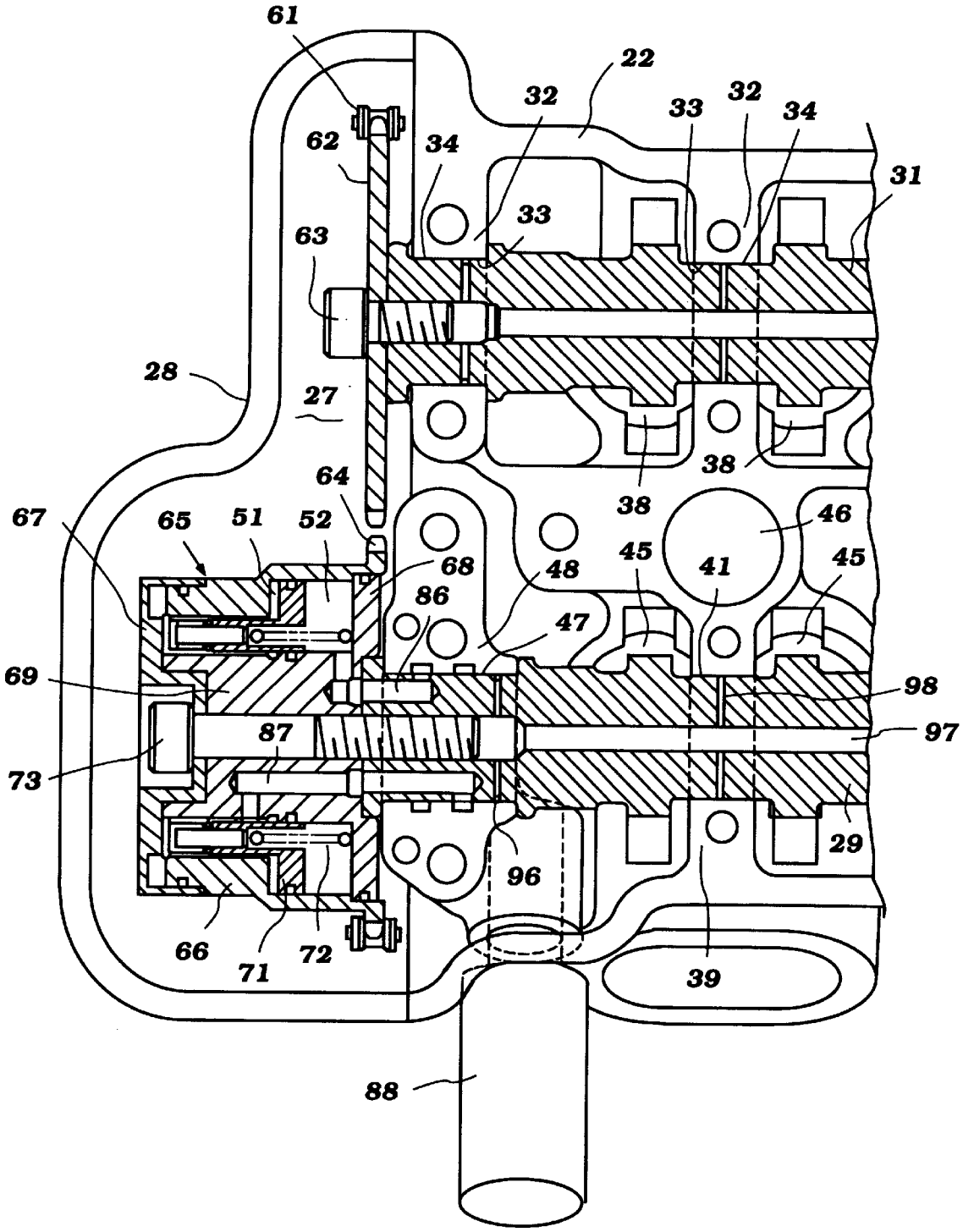
FIG. 2 is a cross-sectional view looking in the same direction as FIG. 1, but with the bearing caps removed and with the camshafts and variable valve timing mechanism shown in the cross section.

The intake camshaft 29 also has lobe portions 44 that are disposed on opposite sides of the bridge portions 39 and which operate the intake valves through thimble tappets received in tappet receiving bores 45 formed in the main cylinder head member 22 (FIG. 2).

The middle portion of the cylinder head bridge portions 32 and 39 are formed with spark plug wells 46 that receive spark plugs for firing the charge in the individual cylinders of the engine.

Figure 3:
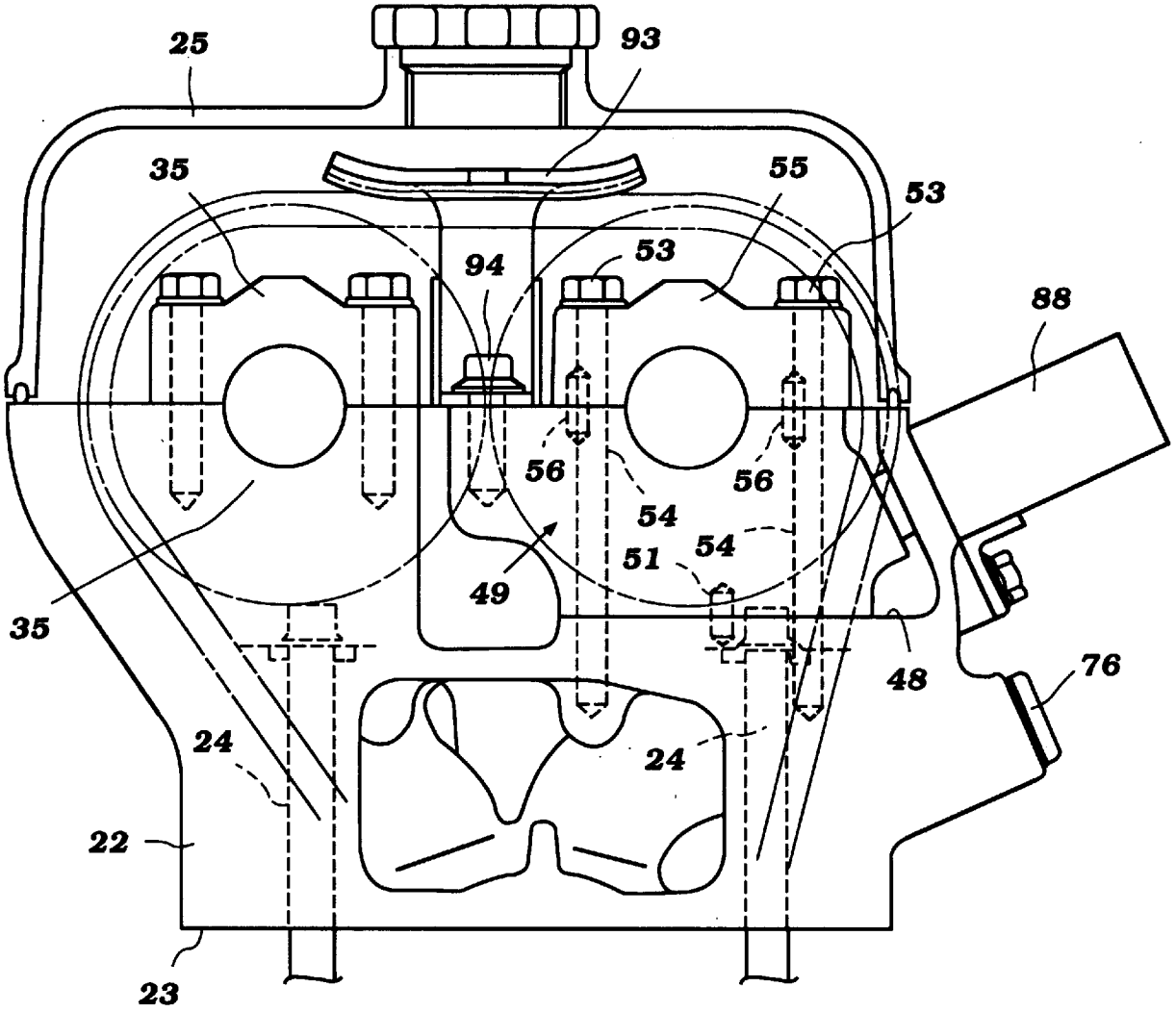
FIG. 3 is a front elevational view of the portion of the engine shown in FIGS. 1 and 2, but, in this instance, with the cam cover in place.

As may be best seen in FIG. 3, the forward portion of the main cylinder head member 22 is provided with a relieved area that is disposed beneath a forward bearing surface 47 of the intake camshaft 29. The lower surface of this relieved area is indicated by the reference numeral 48. A combined camshaft bearing and valve body assembly, indicated generally by the reference numeral 49, is mounted on this surface 48.

At least one locating pin 51 is received in a suitable bore formed in the cylinder head member 22 at the surface 48. This locating pin 51 cooperates with a similar locating bore 52 (FIG. 7) formed on the mating lower surface of the member 49.

A pair of threaded fasteners 53 have shank portions 54 that are threaded into openings formed on the surface 48 of the main cylinder head member 22. In addition, a bearing cap 55 is mounted on the upper surface of the member 49. Locating pins 56 cooperate between the bearing cap 55 and the member 49 for locating the front main bearing cap 55. These locating pins 56 extend into machine bores 57 formed in the upper surface of the member 49 adjacent bores 58 that pass the shanks 54 of the fasteners 53.

Figure 5:
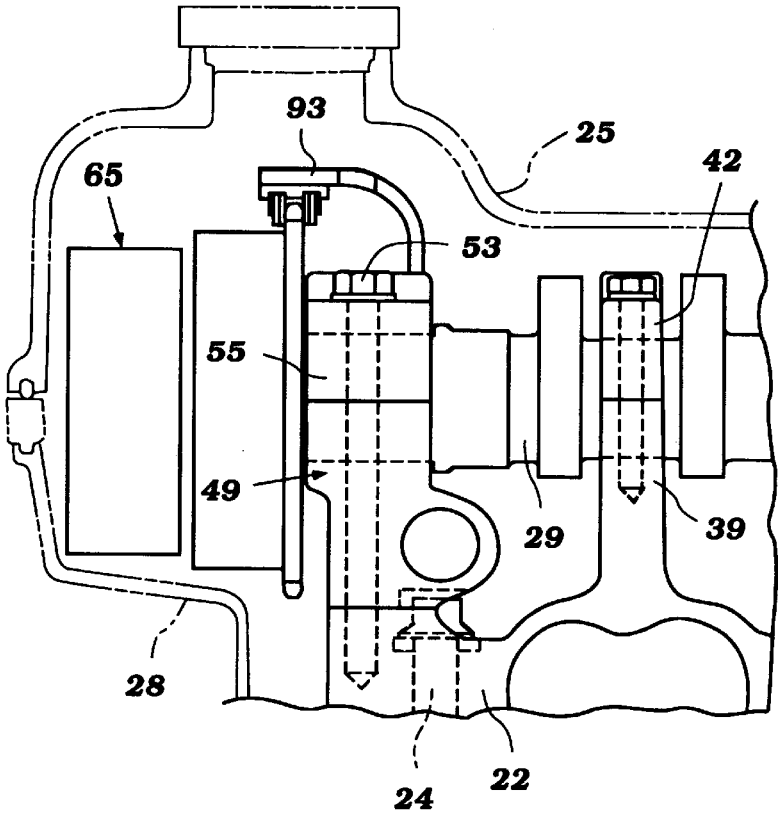
FIG. 5 is a cross-sectional view taken along the line 5—5 of FIG. 1.
Figure 6:
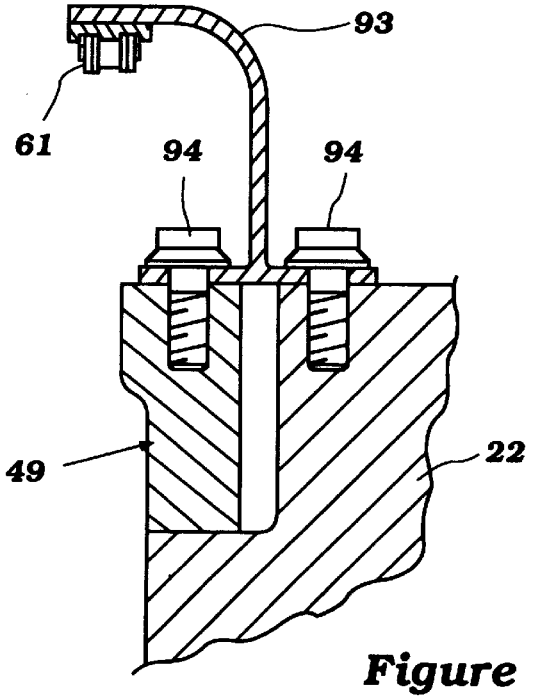
FIG. 6 is an enlarged cross-sectional view looking in the same direction as FIG. 5, but shows the chain follower.

As may be best seen in FIG. 5, the rearward portion of the member 49 is formed with a relief that overlies the upper tool receiving ends of the fastener 24 that secures the cylinder head member 22 to the associated cylinder block so that this fastener in no way serves to fix the member 49 to the main cylinder head member 22.

The drive arrangement for driving the intake camshaft 29 and exhaust camshaft 31 from the crankshaft of the engine will now be described by primary reference to FIGS. 1–3 and 5.

A timing chain 61 is entrained with a sprocket that is affixed to the crankshaft of the engine (not shown) in a well known manner. This timing chain 61 is engaged with a fixed driving sprocket 62 that is held against rotation relative to the exhaust camshaft 31 by a threaded fastener 63 in a suitable spline arrangement.

It should be noted that in this particular embodiment, the phase angle of the exhaust camshaft 31 relative to the crankshaft is not changed. However, and as will become apparent from the description of the embodiments of FIGS. 9 and 10, this timing relationship can be adjusted if desired.

The timing chain 61 is further engaged with a driven sprocket portion 64 of a variable valve timing mechanism, indicated generally by the reference numeral 65. This variable valve timing mechanism 65 has a construction which will be described shortly, and couples the sprocket 64 to the extending portion 47 of the intake camshaft 29. This coupling permits an adjustment in the phase angle of the intake camshaft 29 relative to the timing chain 61, exhaust camshaft 31 and crankshaft.

The variable valve timing mechanism includes an outer housing assembly that is comprised of a respective generally cylindrical, outer member 66 which is closed at one end by an end wall member 67. The driven sprocket 64 is formed integrally with the outer member 66.

The opposite end of the outer member 66 adjacent the driven sprocket 64 is closed by an outstanding flange 68 of an inner member 69 which is affixed in driving relationship to the intake camshaft 29 by means that include threaded fasteners (not shown). It should be noted that the outer housing member 66 and the inner member 69 are supported for relative rotation for a reason which will become apparent.

By changing the rotational angles of the outer and inner members 66 and 69 without interfering with the driving relationship, it is possible to change the valve timing, as is well known in this art. This is accomplished by providing a connection between the outer member 66 and inner member 69 that permits this phase change to be accomplished. The actuation for providing this is provided by providing cylindrical piston 71 reciprocal in a bore formed at one end of the outer member 66 adjacent the wall member 68 of the inner member 69. This piston 71 along with the outer member 66 defines first and second fluid chambers S1 and S2.

The piston 71 has a further inner portion that has a helical, splined connection between the outer member 66 and itself and between itself and the inner member 69 so that axial movement of the piston 71 will change the phase relationship between the sprocket 64 and the camshaft 29.

A coil spring 72 is received in the chamber S2 and urges the piston 71 to the left. By suitably pressurizing and relieving the chambers S1 and S2 respectively, the axial position of the piston 71 can be changed along with the phase relationship. This is done by a hydraulic mechanism that is powered by the lubricating system of the engine, in a manner which will now be described.

The inner member 69 is affixed, by means of a threaded fastener 73 to the intake camshaft 29. As a result, when the phase of the inner member 69 is changed relative to the outer member 66, the phase of the camshaft 29 will be adjusted relative to the sprocket 64 and to change its valve actuating timing.

Figure 4:
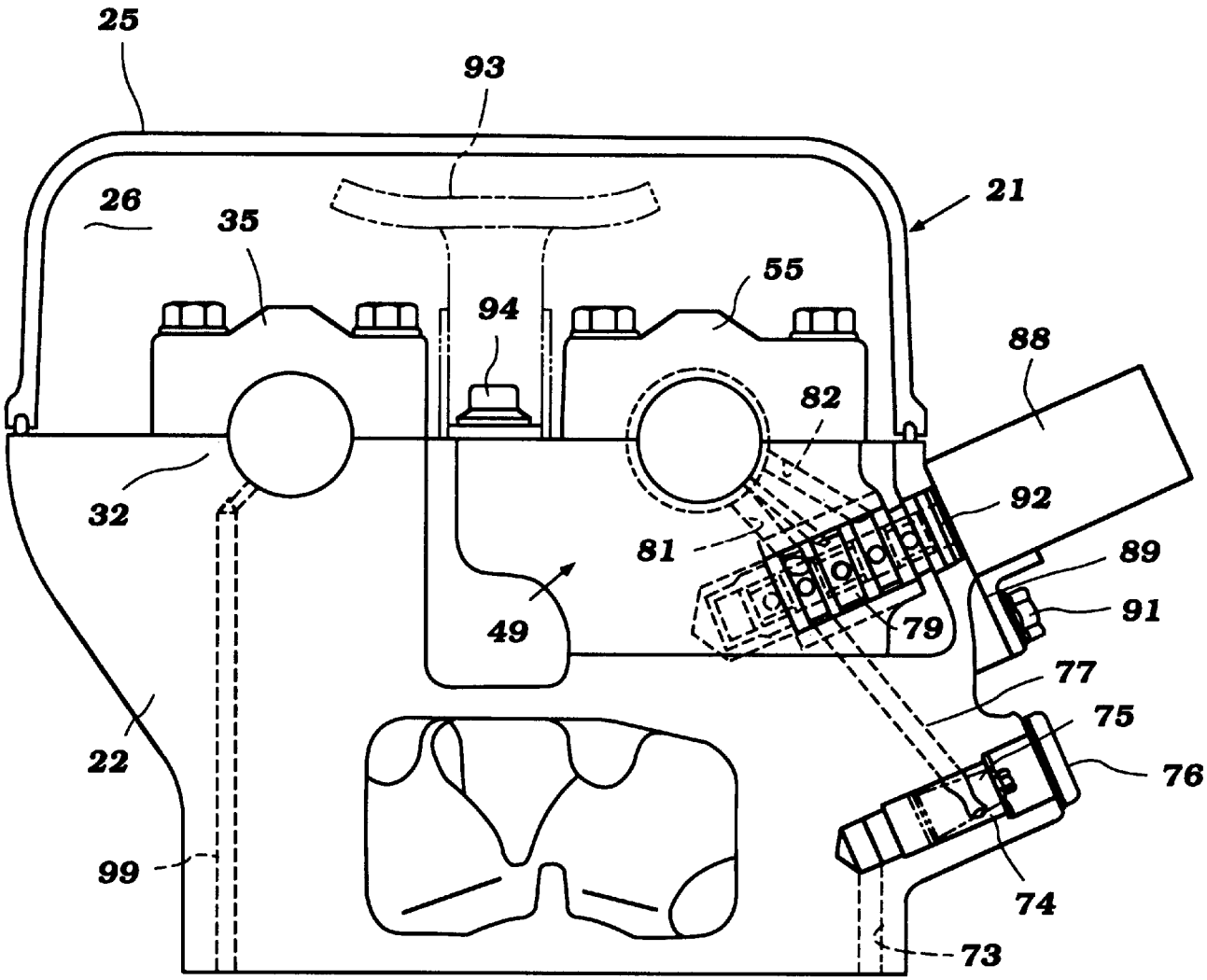
FIG. 4 is a view looking in the same direction as FIG. 3, but shows the construction with the camshafts removed.
Figure 7:
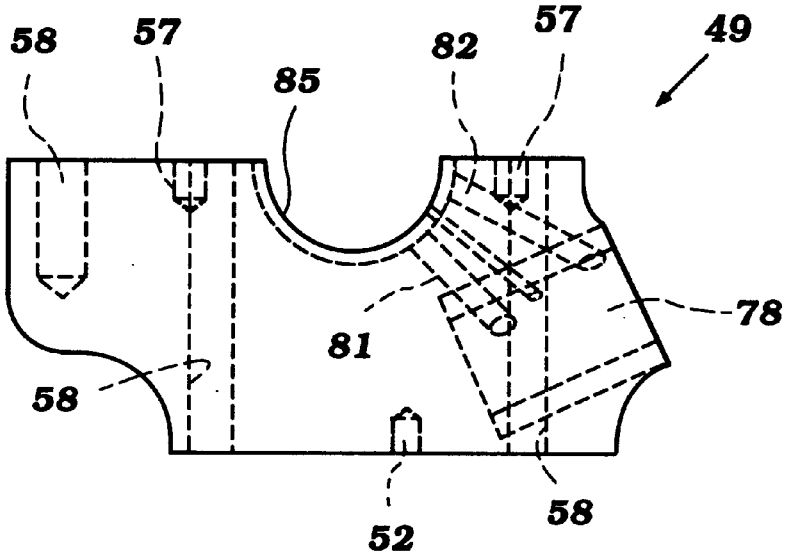
FIG. 7 is an enlarged front elevational view of the camshaft bearing and valve body member of this embodiment.
Figure 8:
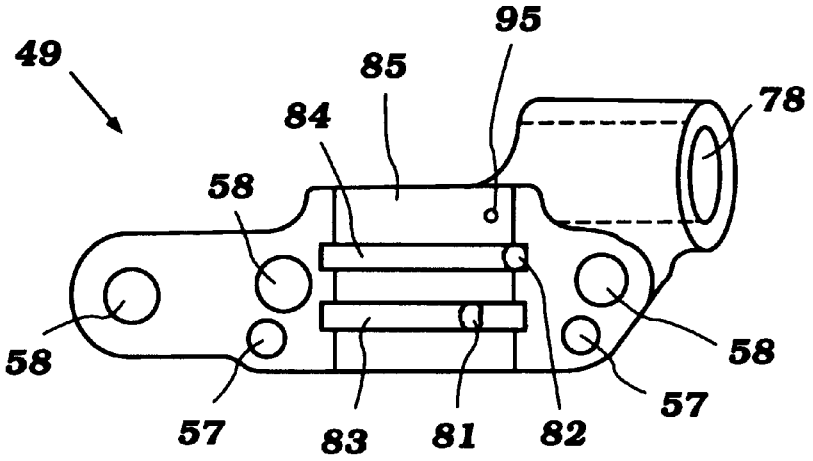
FIG. 8 is a top plan view of the construction shown in FIG. 7.

This phase change is accomplished by means of a hydraulic valve system which appears in FIG. 4 and which is mounted in the cam bearing and valve control member 49 as best seen in FIGS. 7 and 8. An oil passage, indicated at 73 and appearing primarily in FIG. 4, mates with a corresponding oil gallery formed in the cylinder block to which the cylinder head assembly 21 is affixed. Pressurized oil enters this passage and flows upwardly to a chamber 74 formed in one side of the cylinder head member 22. A removable filter element 75 is interposed in this chamber and can be accessed for cleaning purposes by removing a plug 76.

The oil is filtered through the filter element 75 and enters a main delivery passage 77 which extends to a valve bore 78 formed in a projecting portion of the cylinder head member 22. A valve spool 79 is slidably supported in this valve bore 78 and controls the flow of lubricant to first and second control passages 81 and 82 formed in the member 49 and which register with a pair of grooves 83 and 84 formed in the bearing surface 85 of the member 49.

As may be seen in FIG. 2, these grooves 83 and 84 communicate with respective axially extending passageways 86 and 87 formed in the camshaft 29 and in the inner member 69 of the variable valve timing mechanism 65. The passage 87 communicates with the chamber SI, while the passage 86 communicates with the chamber S2.

It should be noted that the valve passage 78, in this embodiment, extends generally perpendicularly to the axis of rotation of the intake camshaft 29 and extends through a side of the cylinder head member 22 below the cam cover 25. An O ring seal 92 seals the valve spool 79 with an opening in the cylinder head member 22 to avoid leakage.

A solenoid motor 88 is mounted on a surface 89 of the cylinder head member 22 and is held in place by fasteners 91. This solenoid motor 88 has an armature that is connected by a coupling to the valve spool 79 so as to effect its axial movement so as to pressurize the chamber S2 and depressurize the remaining chamber. Thus, the phase angle of the intake camshaft 29 can be adjusted in this manner and the valve is mounted so that it can be easily serviced without removing any part of the engine.

A chain guide 93 is affixed to the cylinder head member 29 and the member 49 by threaded fasteners 94 and contacts the back side of the chain 61 so as to ensure it continued engagement with the sprocket 62 and 64.

In addition to providing the source of actuating hydraulic fluid for operating the variable valve timing mechanism 65, the member 49 also has an oil delivery passage 95 which extends into the bearing surface 85 and communicates with a cross-drilling 96 in the intake camshaft 29. This cross-drilling extends through an axially extending passageway 97 so as to deliver oil to the camshaft bearing surfaces 41 through further drilled passages 98.

An oil gallery 99 is also formed in the exhaust side of the cylinder head as seen in FIG. 4 and communicates with the exhaust camshaft 31 for lubrication of its bearing surfaces 34 in a similar manner.

Figure 9:
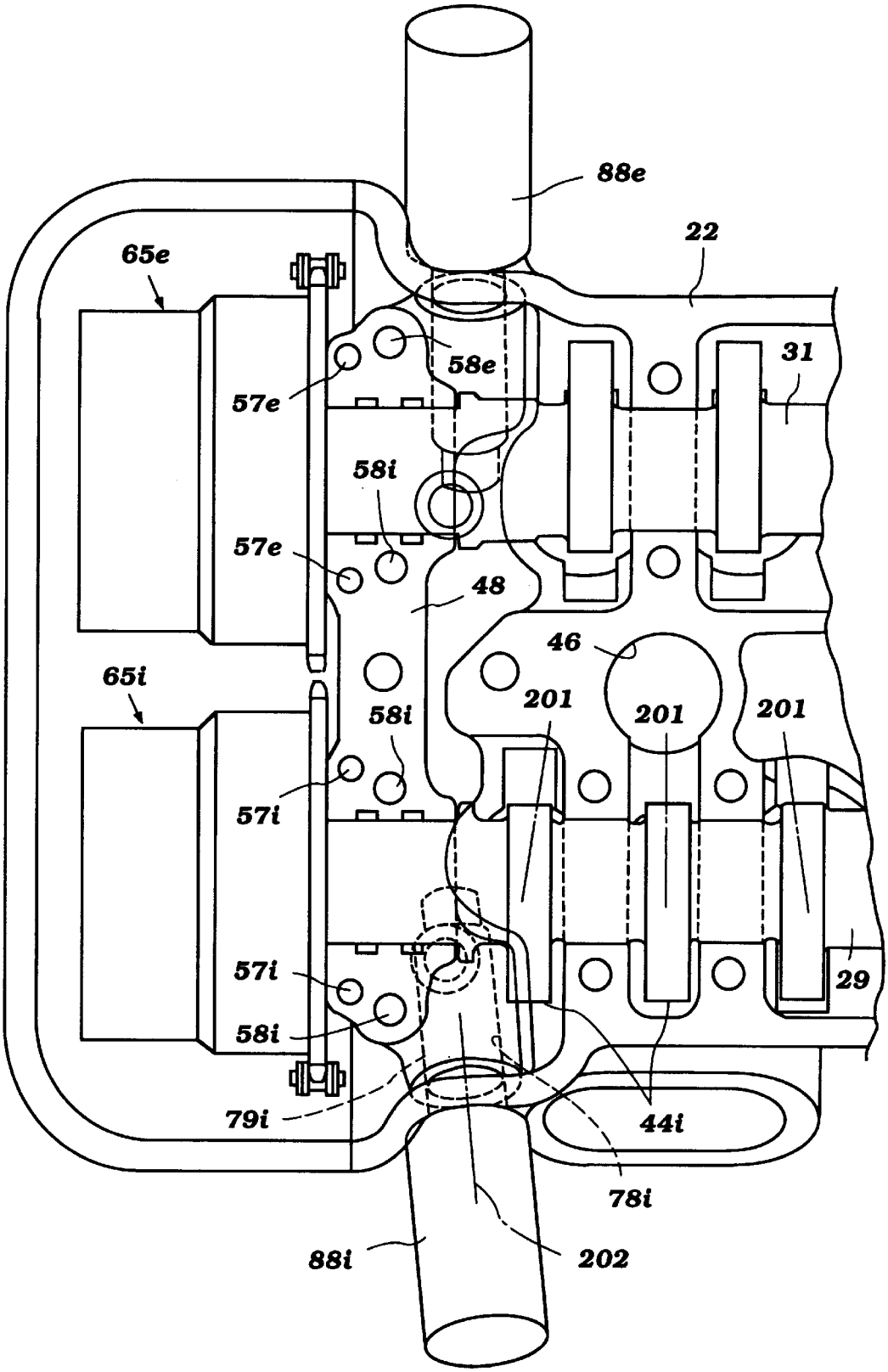
FIG. 9 is a view, in part similar to FIG. 1, and shows a second embodiment of the invention.
Figure 10:
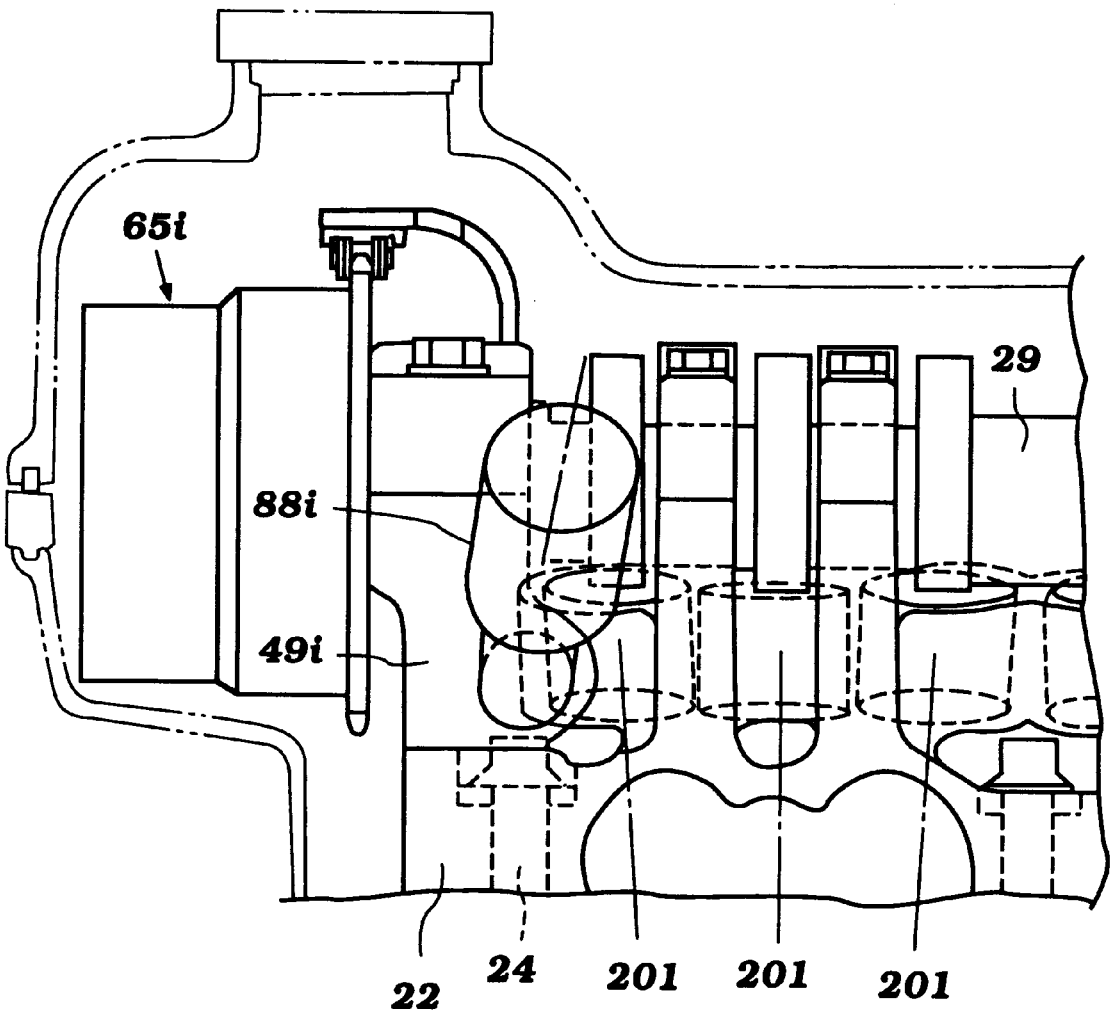
FIG. 10 is a view, in part similar to FIG. 5, but shows this embodiment.

As has been noted, the embodiment as thus far described employs a variable valve timing mechanism for only the intake camshaft. It should be readily apparent to those skilled in the art, that the structure shown can also be utilized either alone for varying the valve timing of the exhaust camshaft 31 or there can be variable valve timing mechanisms associated with both the intake and exhaust camshafts. FIG. 9 shows such an embodiment and also shows how the arrangement can be easily used with an engine having five valves per cylinder.

Because the components of this embodiment are basically the same as those in the previously described embodiments, they have been identified by the same reference numeral. However, the variable valve timing mechanism associated with the intake camshaft 29 has its reference characters designated with the suffix "i" while those of the variable valve timing mechanism for the exhaust camshaft 31 have their identifying numbers noted with the suffix "e".

In this embodiment, however, the intake camshaft is provided with three lobes **44*i* because of the fact that the engine is provided with three intake valves. Although these valves are not shown, their axes are identified by the reference numerals 201 and it will be seen that the center axis basically extends perpendicularly to the axis of the intake camshaft 29 while the other axis 201** extends at an angle to a point of intersection that will lie within the cylinder bore of the associated cylinder.

Thus, the forward-most lobe **44*i* is closer to the front end of the engine and leaves lesser space for the variable valve timing mechanism. However, this is accommodated without lengthening the engine by valve bore 78*i* in the member 49*i* so that the axis, indicated by the line 202 extend in the opposite direction to the valve axis 201 of the forward-most intake valve. Thus, the member 49*i* can be elongated at only one side of the engine so as to clear the cam lobe 44*i* and also leave adequate room for the valve mechanism including the valve bore 78*i* and the valve spool 79*i***.

In all other regards, this embodiment is the same as that previously described and, therefore, further description of this embodiment is not believed to be necessary to permit those skilled in the art to practice the invention.

It is to be understood, however, that the foregoing description is that of preferred embodiments of the invention and that various changes and modifications can be made without departing from the spirit and scope of the invention, as defined by the appended claims.

I claim:

1. A cylinder head for an internal combustion engine variable valve timing mechanism comprised of a main cylinder head member, a bearing member defining a bearing surface for journaling a corresponding bearing surface of a camshaft, said camshaft having a portion that extends on one side of said bearing member bearing surface, a hydraulically operated, variable valve drive element for changing the phase angle between said camshaft and a camshaft drive element associated with said camshaft portion, a hydraulic conduit extending through said bearing member for supplying controlled hydraulic actuating fluid to said hydraulically operated variable valve drive element, said bearing member being detachably connected to said main cylinder head member independently of fasteners that fix said main cylinder head member to an associated cylinder block, an operating valve element for controlling the supply of hydraulic fluid through said hydraulic conduit mounted in said bearing member, and a valve actuator mounted directly on said main cylinder head member for actuating said operating valve element.

2. A cylinder head for an internal combustion engine variable valve timing mechanism as set forth in claim 1, wherein the operating valve element comprises a spool valve mounted for reciprocation along an axis defined by a bore in the bearing member.

3. A cylinder head for an internal combustion engine variable valve timing mechanism as set forth in claim 2, wherein the reciprocal axis of the spool valve extends transversely to the axis of rotation of the camshaft and passes through a side surface of the cylinder head.

4. A cylinder head for an internal combustion engine variable valve timing mechanism as set forth in claim 3, further including a solenoid motor for actuating the spool valve affixed to the cylinder head side surface.

5. A cylinder head for an internal combustion engine variable valve timing mechanism as set forth in claim 1, wherein the portion of the hydraulic conduit formed in the bearing member terminates in an inlet opening formed in an external surface thereof that is engaged with the main cylinder head member and which receives hydraulic fluid from said main cylinder head member.

6. A cylinder head for an internal combustion engine variable valve timing mechanism as set forth in claim 5, further including a removable filter element positioned in the main cylinder head member portion of the hydraulic conduit.

7. A cylinder head for an internal combustion engine variable valve timing mechanism as set forth in claim 6, wherein the removable filter element is positioned in a bore in the main cylinder head member that extends through an outer surface thereof which is closed by a removable plug for servicing of said removable filter element.

8. A cylinder head for an internal combustion engine variable valve timing mechanism as set forth in claim 1 wherein the cylinder head journals two camshafts each of which operates a respective series of valves.

9. A cylinder head for an internal combustion engine variable valve timing mechanism as set forth in claim 8, wherein the variable valve timing element is associated with only one of the camshafts.

10. A cylinder head for an internal combustion engine variable valve timing mechanism as set forth in claim 8, wherein there is a variable valve timing element associated with each of the camshafts.

11. A cylinder head for an internal combustion engine variable valve timing mechanism as set forth in claim 10, wherein each variable valve timing element and the respective camshaft is journalled and actuated by a respective bearing member detachably connected to the main cylinder head member independently of fasteners that fix said main cylinder head member to an associated cylinder block, an operating valve element for controlling the supply of hydraulic fluid through a respective hydraulic conduit mounted in said respective bearing member, and a valve actuator mounted directly on said main cylinder head member for actuating the respective operating valve element.

12. A cylinder head for an internal combustion engine variable valve timing mechanism as set forth in claim 11, wherein the operating valve elements comprises spool valves mounted for reciprocation along respective axes defined by a bore in the respective bearing member.

13. A cylinder head for an internal combustion engine variable valve timing mechanism as set forth in claim 12, wherein the reciprocal axes of the spool valves extend generally transversely to the axis of rotation of the respective camshaft and pass through opposite side surfaces of the cylinder head.

14. A cylinder head for an internal combustion engine variable valve timing mechanism as set forth in claim 13, wherein there are more valves per cylinder actuated by one of the camshafts than the other of the camshafts.

15. A cylinder head for an internal combustion engine variable valve timing mechanism as set forth in claim 14, wherein the bore receiving the valve spool of the other camshaft extends perpendicularly to said other camshaft axis while the bore receiving the valve spool of the one camshaft extends at an acute angle to said one camshaft axis.

* * * * *